US005691734A

United States Patent [19]

Davies

[11] Patent Number: 5,691,734

[45] Date of Patent: Nov. 25, 1997

[54] DUAL POLARIZATING ANTENNAE

[75] Inventor: Richard Simon Greville Davies, Cheltenham, United Kingdom

[73] Assignee: Alan Dick & Company Limited, Cheltenham, United Kingdom

[21] Appl. No.: 457,133

[22] Filed: Jun. 1, 1995

[30] Foreign Application Priority Data

Jun. 1, 1994 [GB] United Kingdom ..... 9410994

[51] Int. Cl.[6] ..... H01Q 9/28; H01Q 21/26

[52] U.S. Cl. ..... 343/795; 343/797; 343/815

[58] Field of Search ..... 343/700 MS, 767, 343/770, 795, 797, 846, 815, 818

[56] References Cited

U.S. PATENT DOCUMENTS

| | | | |
|---|---|---|---|
| 3,025,524 | 3/1962 | Thies | 343/795 |
| 3,952,310 | 4/1976 | Griffee et al. | 343/797 |
| 4,590,478 | 5/1986 | Powers et al. | 343/700 MS |
| 4,843,400 | 6/1989 | Tsao et al. | 343/700 MS |
| 4,903,033 | 2/1990 | Tsao et al. | 343/700 MS |
| 4,922,263 | 5/1990 | Dubost et al. | 343/797 |
| 5,166,697 | 11/1992 | Viladevall et al. | 343/795 |
| 5,241,321 | 8/1993 | Tsao | 343/700 MS |
| 5,293,176 | 3/1994 | Elliot | 343/797 |
| 5,319,377 | 6/1994 | Thomas et al. | 343/795 |

FOREIGN PATENT DOCUMENTS

| | | |
|---|---|---|
| 0 044 779 | 1/1982 | European Pat. Off. . |
| 0 243 289 | 10/1987 | European Pat. Off. . |
| 0 342 175 | 11/1989 | European Pat. Off. . |
| 0 355 898 | 2/1990 | European Pat. Off. . |
| 0 502 818 | 9/1992 | European Pat. Off. . |
| 0 516 525 | 12/1992 | European Pat. Off. . |
| 0 543 519 | 5/1993 | European Pat. Off. . |
| 0 557 176 | 8/1993 | European Pat. Off. . |
| 2 603 744 | 3/1988 | France . |
| 2 677 814 | 12/1992 | France . |
| 1 364 941 | 8/1974 | United Kingdom . |
| 2 195 832 | 4/1988 | United Kingdom . |
| 2 241 831 | 9/1991 | United Kingdom . |
| 2 241 832 | 9/1991 | United Kingdom . |
| 2 261 554 | 5/1993 | United Kingdom . |
| 2 261 771 | 5/1993 | United Kingdom . |
| 2 279 813 | 1/1995 | United Kingdom . |
| WO93/11582 | 6/1993 | WIPO . |

OTHER PUBLICATIONS

M. Edimo et al., "Optimised Feeding of Dual Polarised Broadband Aperture–Coupled Printed Antenna", *Electronics Letters*, vol. 28, No. 19, Sep. 10, 1992, pp. 1785–1787.

R.C. Hall et al., "Performance Enhancements for aperture Coupled Microstrip Antennas", 1992, IEEE, pp. 1040–1043 no month.

R. C. Hall et al., "Performance Enhancements for Aperture Coupled Microstrip Antennas", 1992 IEEE, pp. 1040–1043. No Month.

F. Rostan et al., "Wideband Aperture–Coupled Microstrip Patch Array for Satellite TV Recpetion", pp. 190–193. No Date.

(List continued on next page.)

*Primary Examiner*—Donald T. Hajec
*Assistant Examiner*—Tan Ho
*Attorney, Agent, or Firm*—Young & Thompson

[57] ABSTRACT

A dual polarization antenna includes a non-conducting space surrounded by a ground plane. Two angularly offset sets of dipole structures penetrate into the space. Each set of dipole structures comprises a pair of aligned short circuit elongate dipoles extending from the ground plane into the space from diametrically opposed directions and terminating in respective free ends. The free ends are adjacent, but spaced from each other, to define a gap between them. At least one separate device is provided for exciting each set of dipole structures or each dipole structure within a set individually. A radiating element is provided overlying the dipole structures such that the dipole structures couple, in use, with the radiating element, causing the radiating element to radiate polarizations determined by the orientation of each of the sets of dipole structures.

17 Claims, 5 Drawing Sheets

OTHER PUBLICATIONS

S. D. Targonski et al., "Design of Wideband Circularly Polarized Aperture–Coupled Microstrip Antennas", 1993 IEEE, pp. 214–220. No Month.

J.R. Gentle et al., "A Simple Aperture Feed for CP Microstrip Patch Antennas", 1991 IEEE, pp. 1102–1105. No Month.

J. F. Wagen et al., "Time Dispersion Measurements Using a SSFIP Base Station Antenna", 1992, IEEE, pp. 5–8. No Month.

D.M. Pozar, "Microstrip Antenna Aperture–Coupled to a Microstripline", *Electronics Letters*, vol. 21, No. 2, Jan. 17, 1985, pp. 49–50.

G. Dubost, "Comparison Between Flat Radiating Source Bandwidth". No Date.

D.M. Pozar, "A Reciprocity Method of Analysis for Printed Slot and slot–Coupled Microstrip Antennas", 1986 IEEE, pp. 14391446. No Month.

J.F. Zurcher, "The SSFIP: A Global Concept for High–Performance Broadband Planar Antennas", *Electronics Letters*, vol. 24, No. 23, No. 10, 1988, pp. 1433–1435.

A. Adrian et al., "Dual Aperture–Coupled Microstrip antenna for dual or Circular Polarisation", *Electronics Letters*, vol. 23, No. 23, Nov. 5, 1987, pp. 1226–1228.

M.I. Aksun et al., "Theory and Experiment of electromagnetically Excited Microstrip antennas for Circular Polarization Operation", 1989 IEEE, pp. 1142–1145. No Month.

D.M. Pozar et al., "A Novel Wideband Circularly Polarized Aperture Coupled Microstrip Antenna", 1991 IEEE, pp. 1098–1101. No Month.

S.D. Targonksi et al., "Improved Coupling for Aperture Coupled Microstrip Antennas", *Electronics Letters*, vol. 27, No. 13, Jun. 20, 1991, pp. 1129–1131.

DUAL POLARIZATING ANTENNAE

BACKGROUND OF THE INVENTION

1. Field of the Invention

This invention relates to a dual polarisation antennae.

2. Description of the Related Art

In these days of satellite broadcasting and large mobile phone usage, there is an ever-increasing need for antennae which radiate and receive dual polarised radiation and which have a simplicity of manufacture and a discreet appearance. Considerable work has been done, particularly in the field of so-called slot antennae, but almost all designs have required a significant number of layers of components or they have had other disadvantages such as a peculiar lack of symmetry or limited band widths.

SUMMARY OF THE INVENTION

From one aspect the present invention consists in a dual polarisation antenna including a non-conducting space, two angular offset sets of short-circuited dipole structures penetrating into or overlying the space, each set comprising a pair of aligned dipole structures extending into or over the space from diametrically opposed directions such that their free ends are adjacent but spaced from each other to define a gap between them and separate means for exciting each set, or dipole structure within a set, individually.

It is particularly preferred that the antenna also includes a radiating element overlying the dipole structures such that they couple, in use, with the element causing it to radiate polarisations determined by the orientations of the respective sets.

As is well known antennae which transmit also receive in a reciprocal manner and any terminology in this specification which implies or requires transmission is to be understood as including the corresponding receiving function.

The dipole structure may be constituted by a short-circuit dipole. Alternatively, when the space is surrounded by a ground plane, each dipole structure may comprise a conducting element extending from the ground plane and a pair of parallel open-circuit dipoles extending from the free end back along respective sides of the conducting element. In that case the conducting element may be connected to the ground plane at a voltage node.

Preferably the gap between the dipole structures is common to each set. It is further preferable that the dipole structures extend from a common ground plane and in particular they may be continuous with that ground plane. Thus, for example, the ground plane and dipole structures may be in the form of a deposited metallic conducting layer on the surface of an insulating support, which can be planar, and the space may be an aperture in that layer which can conveniently be formed by etching. Thus, more generally, the ground plane may surround and define the non-conducting space and in certain arrangements it may be desirable to have the dipole structures in a separate plane from the ground plane so that they overlie, rather than penetrate, the space. In this and other context the word "overlie" is intended to cover the circumstances where one thing is either above or below the other and the term is not affected by the particular orientation.

It is particularly preferable that the dipole structures are symmetrically disposed within the space and indeed that the space, radiating element and dipole structures are symmetrical about the intended planes of polarisation. Thus conveniently the space and/or the radiating element may be circular, square or polygonal. In this arrangement the radiation phase centers of the sets of dipole structures should be coincident, but any other configuration which achieves this coincidence is also desirable. For most purposes it is expected that the sets of dipole structures will be orthogonal.

It is envisaged that the dipole structures will act at one quarter wave resonance, or multiples thereof, and hence may consist of a narrower strip about a one quarter wave length long, at the central desirable operating frequency. It will be excited by applying a voltage from the free end either to the ground plane or to the opposite similar dipole structure in the set. For the short circuit dipoles, the free end will be a voltage antinode, in these circumstances, whilst the grounded end will be a voltage node.

In transmission mode, the dipole structures can be excited in a number of ways for example at least one exciting means may comprise a feed line extending along, but spaced from, a first of the dipole structures in its set, across the gap and along, but spaced from, a part of the second dipole structure to form an open circuit stub. In many arrangements this feed line will be in a different plane to the dipole structures, but in at least one configuration the feed line may be co-planar with the dipole structures, in which case each dipole structure may be in the form of parallel probes and the feed line may extend between them to form a co-planar wave guide feed arrangement.

The open circuit stub may be tuned to be short circuit at the intended operating frequency and the feed line may be connected to one or both dipole structures by a probe. Conveniently the feed line can be microstrip or stripline in many embodiments. One alternative is a coaxial feed whose outer conductor is connected to a first of the dipole structures in its set and whose inner conductor is connected to the second dipole structure in that set.

Although the invention has been defined above it is to be understood that it includes any inventive combination of the features set out above or in the following description.

BRIEF DESCRIPTION OF THE DRAWINGS

The invention may be performed in various ways and specific embodiments will now be described, by way of example, with reference to the accompanying drawings, in which.

DESCRIPTION OF THE PREFERRED EMBODIMENTS

Figure 1:
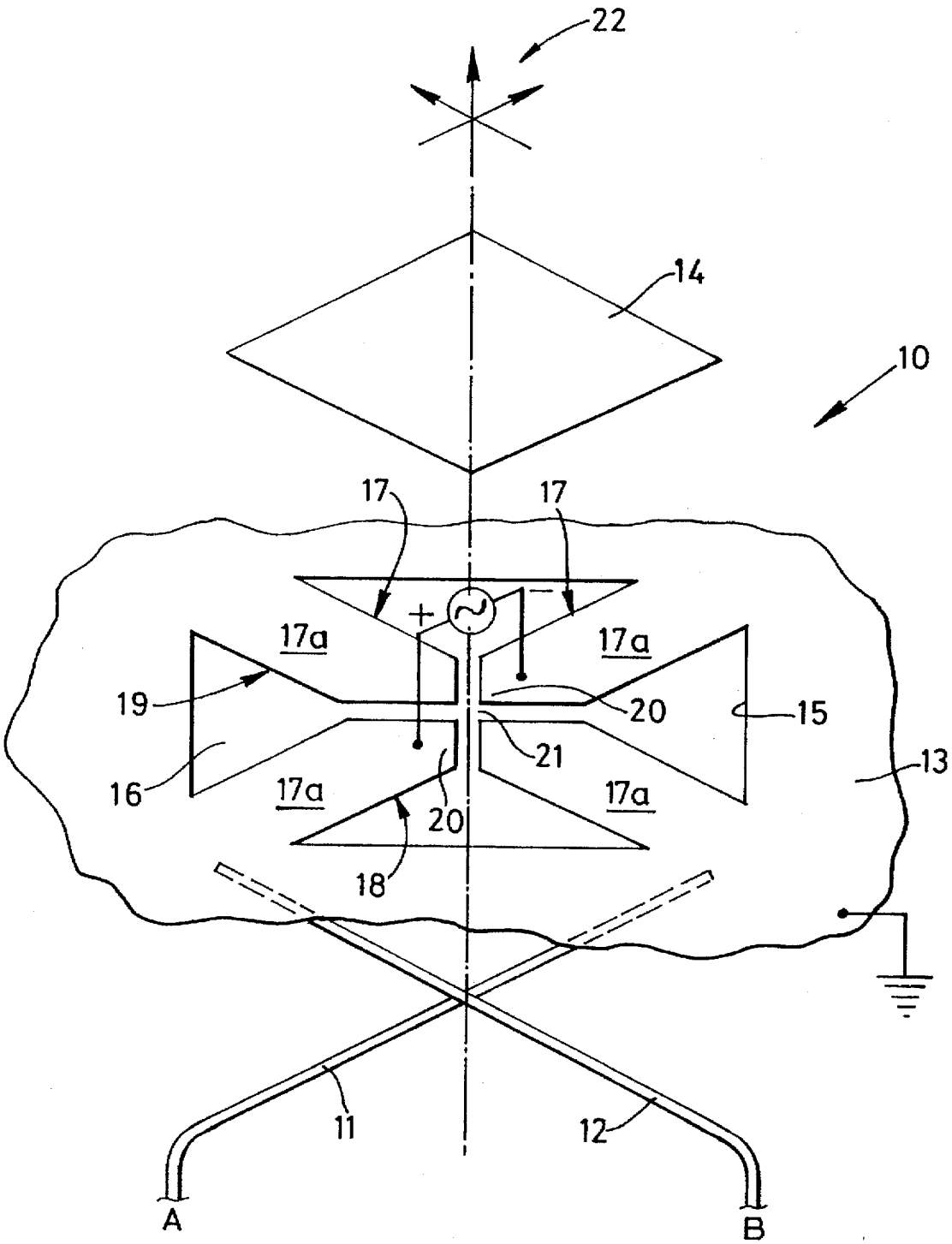
FIG. 1 is a schematic exploded view of an antenna according to the invention.
Figure 2A:
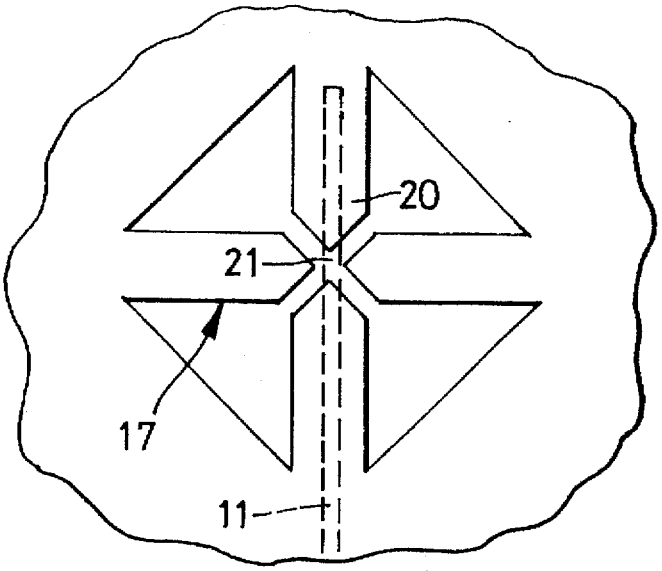
FIGS. 2 to 7 show a view from above at a and a sectional view at b of a number of different ways of exciting the antenna of FIG. 1 (a single polarisation excitation means is shown, for clarity, in each case, the other corresponds)
Figure 2B:
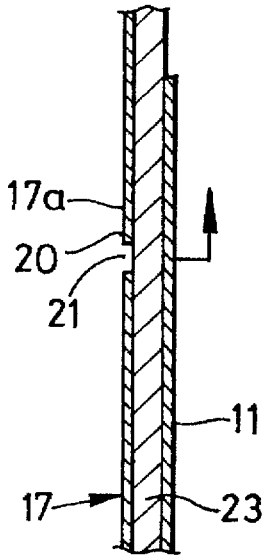

Referring to FIG. 1 an antenna 10 comprises feed lines 11, 12 which are fed from frequency sources (not shown) A and B; a conducting plate 13 mounted on a planar non-conducting element (not shown) and an overlying radiating patch or element 14. The conducting plate is etched away at a central portion 15 so that it effectively defines a non-conducting rectangular space 16 into which project dipoles 17. The dipoles structures 17, which are constituted by short circuit dipoles 17*a*, are arranged in generally orthogonal sets 18, 19, each of which comprises a pair of dipoles 17*a* which extend into the space 16 from diametrically opposed directions such that their free ends 20 are adjacent, but spaced from each other, to define a gap 21 between them.

It will be seen that the arrangement of space 16, dipoles 17*a* and patch or radiating element 14 is symmetrical about the longitudinal axes of the dipoles 17*a*, which, as will be seen below, correspond with the plane of polarisation of the dipoles.

Thus the feed lines 11, 12 extend along, but are spaced from, a first of the dipoles in each set 18, 19, across the gap 21 to terminate adjacent the far end of the other dipole 17*a* in the set 18, 19 so that the feed lines form open circuit stubs tuned to short circuit at the intended operating frequency of the antenna. It will also be noted that the dipoles 17*a* are each connected to the main body of the conducting plate 13 which is earthed to form a ground plane. It is preferable that the dipoles are a one quarter wave length long, at the operating frequency. When the feed lines 11, 12 receive respective signals, an exciting voltage is induced across the free ends of the dipoles in the respective set so that the free end is a voltage anti-node while the ground end is a node. Each set of dipoles 18, 19 couples with the patch to cause dual polarised radiation as indicated at 22.

As has been mentioned previously, it is desirable that the space 16, the dipoles 17*a* and the patch 14 are symmetrical about the polarisation planes and hence the space and patch are conveniently symmetrical geometrical shapes such as squares, circles etc.

Figure 3A:
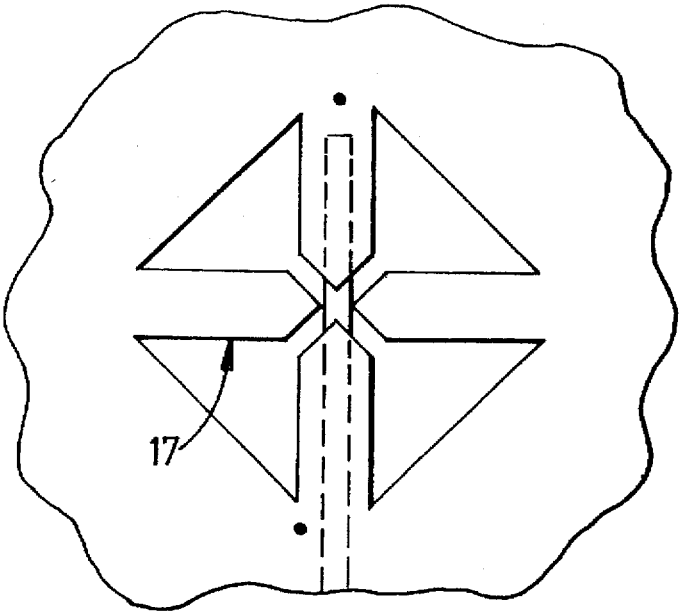
Figure 3B:
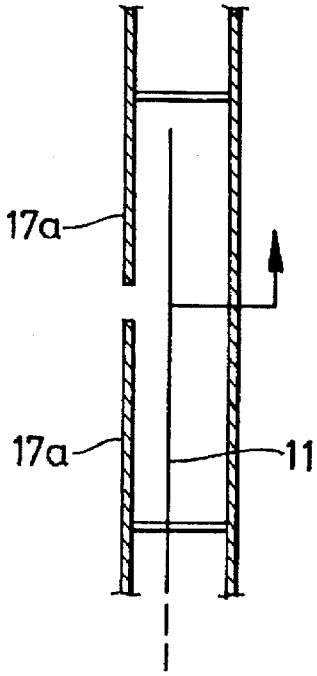
Figure 4A:
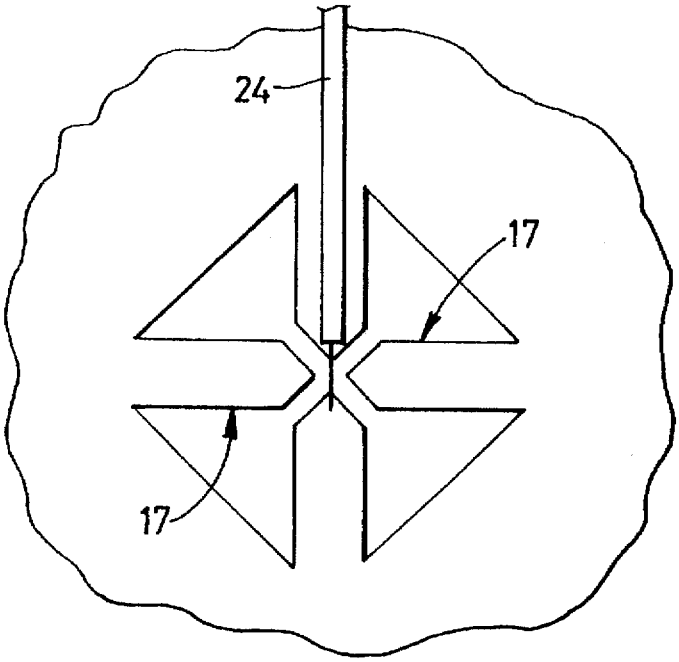
Figure 4B:
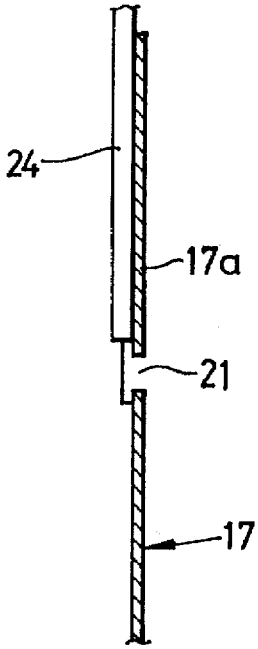
Figure 5A:
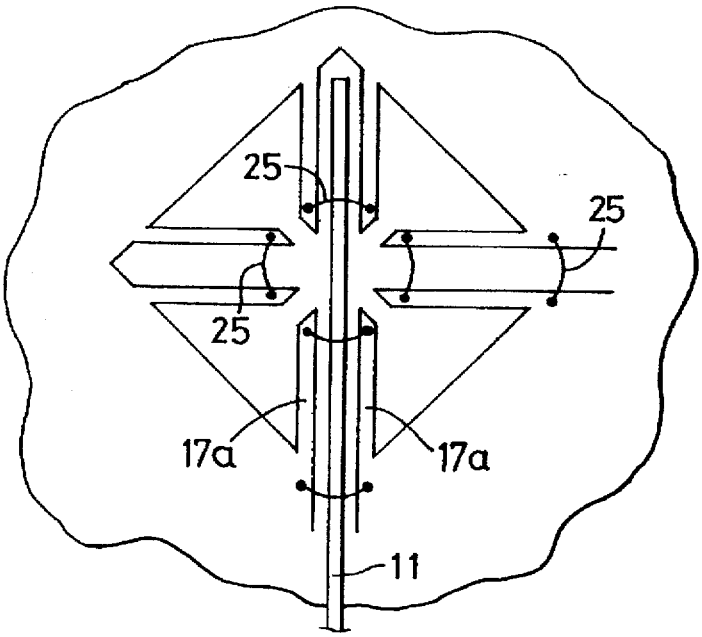
Figure 5B:
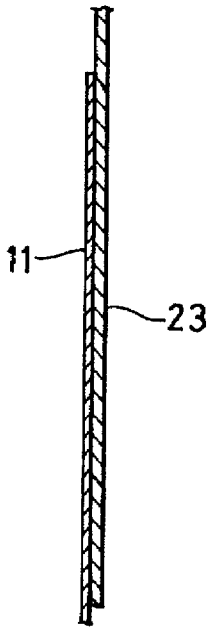
Figure 6A:
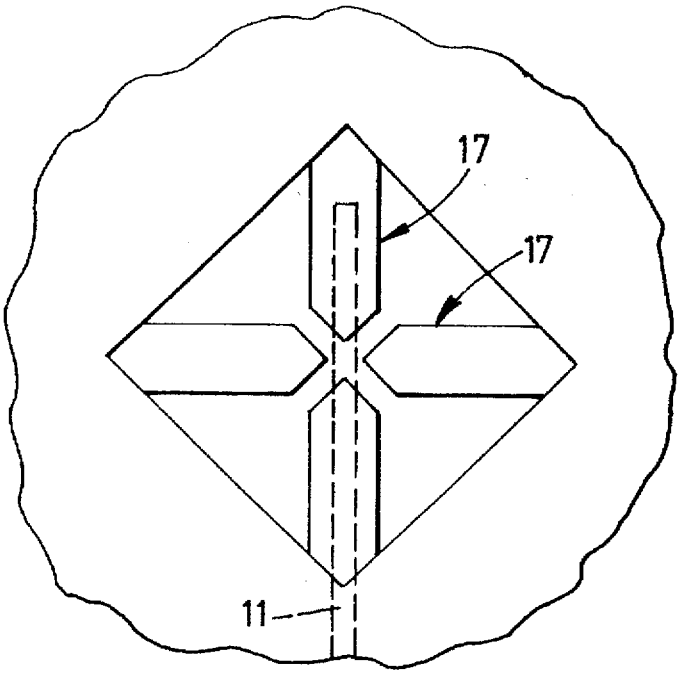
Figure 6B:
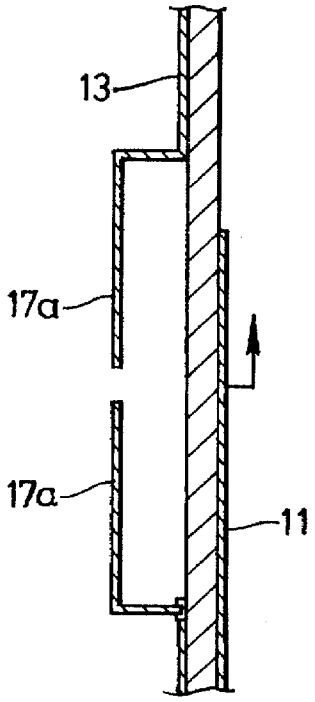
Figure 7A:
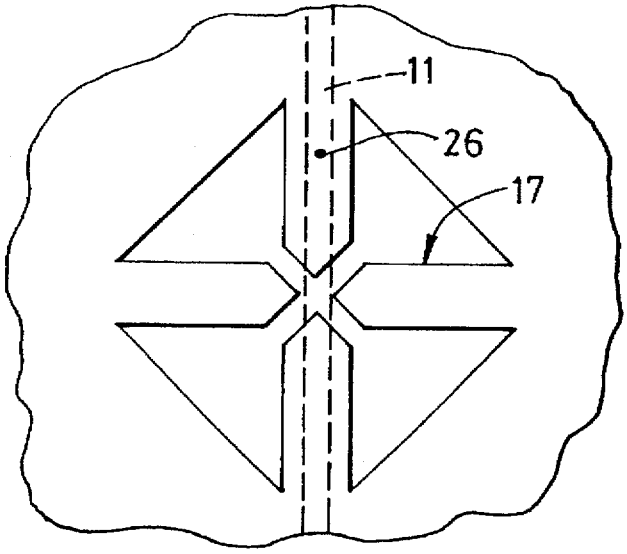
Figure 7B:
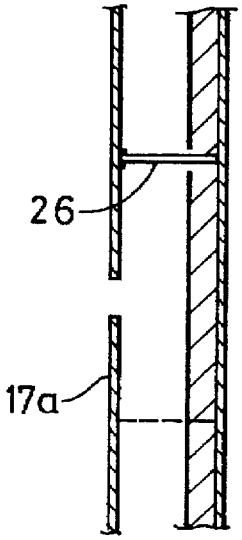

Turning to FIGS. 2 to 7, each illustrates a different way of exciting the antenna of FIG. 1 but essentially using the principles outlined above. For clarity only one polarisation is illustrated. Thus FIG. 2 indicates more clearly the arrangement of FIG. 1 and shows the feed line 11 being mounted on one side of a dielectric plate 23 with the ground plane and dipoles formed on the other side. In this case, the feed line 11 is a microstrip. In FIG. 3 a stripline feed extends between a pair of ground planes which are earthed together. The conducting plate 13 may be a sheet of metal, a metal clad laminate or a flexible circuit. Dielectric foam may be used to space the components apart. FIG. 4 illustrates a coaxial feed 24 while FIG. 5 shows how the arrangement of FIG. 1 can be almost entirely coplanar, other than the jumper leads 25, by using co-planar wave guide feeds. FIG. 6 shows an arrangement in which the dipoles 17*a* are stepped away from the ground plane and this may be particularly convenient for generating a locally high impedance for matching purposes. FIG. 7 illustrates how the dipoles 17*a* may be fed directly using a probe 26 from a microstrip feedline 11.

Figure 8:
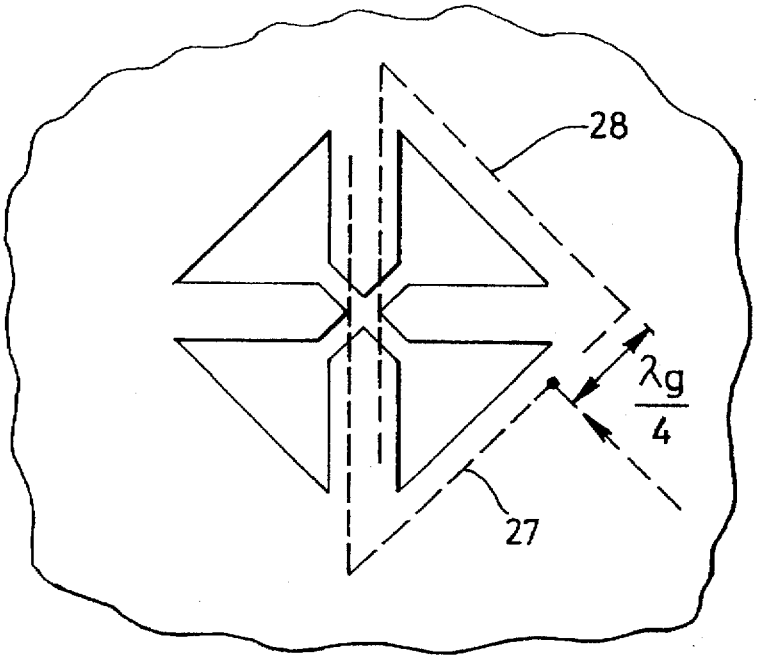
FIG. 8 is a view from above illustrating a further means of excitation.

Finally FIG. 8 illustrates a method of feeding both dipoles in a set with oppositely directed feed lines 27, 28 connected in parallel to the feed line 11 in such a way that one of the feed lines 26 is one quarter of a wave length longer than the other creating an effective half wave length delay to give a 4:1 impedance transform enabling the antenna to be matched directly to low impedance feeds.

It will be understood that when used as a receiving aerial, the antenna operates in exactly the reciprocal manner.

Figure 9:
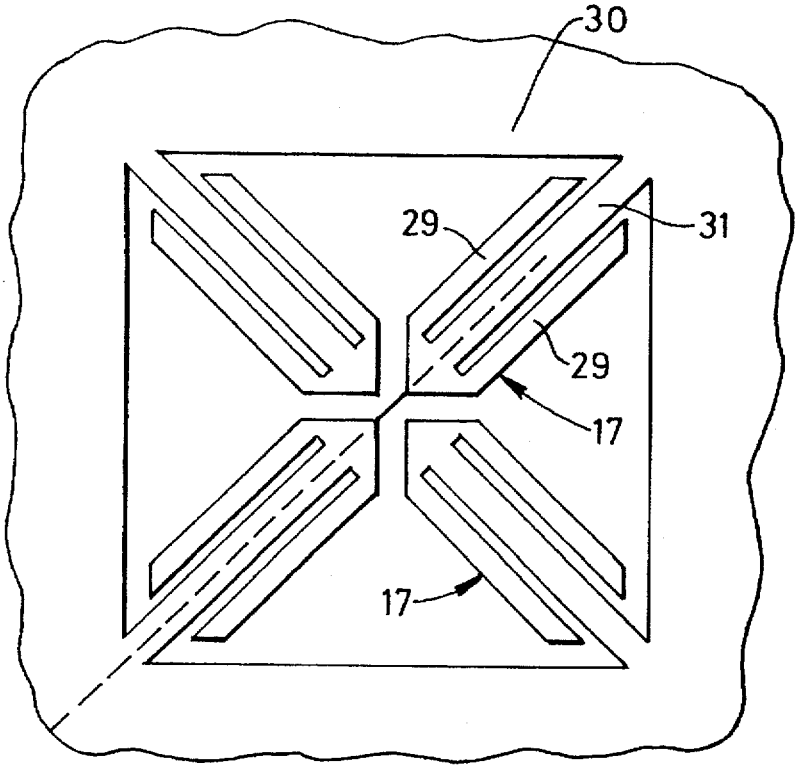
FIG. 9 is a view from above of an alternate form of an antenna.

FIG. 9 shows an analogous form of antenna using open-circuit dipoles. Thus the dipole structures 17*a* comprises open-circuit dipoles 29 which extend back along respective sides of a conducting element 31, which is connected to the ground plane 30. This antenna may be fed and manufactured in the manners previously described.

I claim:

1. A dual polarization antenna including a non-conducting space surrounded by a ground plane; two angularly offset sets of dipole structures penetrating into the space, each set having an orientation and comprising a pair of aligned short circuit elongate dipoles extending from the ground plane into the space from diametrically opposed directions to terminate in respective free ends such that said free ends are adjacent but spaced from each other to define a gap between them; separate means for exciting each set, or dipole structure within a set, individually and a radiating element overlying the dipole structures such that the dipole structures couple, in use, with the radiating element, causing said radiating element to radiate polarizations determined by the orientation of each of said sets of dipole structures.

2. An antenna as claimed in claim 1, wherein each dipole structure of said sets of dipole structures comprises a conducting element extending from the ground plane to the respective free end, and a pair of parallel open-circuit dipoles extend from the respective free end back along respective sides of the conducting element.

3. An antenna as claimed in claim 2, wherein the conducting element is connected to the ground plane at a voltage node.

4. An antenna as claimed in claim 1, wherein the gap between the dipole structures is common to each set of said two angularly offset sets of dipole structures.

5. An antenna as claimed in claim 1, wherein the dipole structures are continuous with the ground plane.

6. An antenna as claimed in claim 1, wherein the ground plane and dipole structures are in the form of a metallic conducting layer on the surface of an insulating support.

7. An antenna as claimed in claim 6, wherein the support is planar.

8. An antenna as claimed in claim 2, wherein the dipole structures are symmetrically disposed within the space.

9. An antenna as claimed in claim 8, wherein the space, radiating elements and dipole structures are symmetrical about intended planes of polarisation.

10. An antenna as claimed in claim 1, further comprising at least one exciting means comprising a feed line extending along, but spaced from a first of dipole structures in a first set of dipole structures, across the gap and along but spaced from, a part of a second dipole structure to form an open circuit stub.

11. An antenna as claimed in claim 10, wherein the open circuit stub is tuned to be a short circuit at the intended operating frequency.

12. An antenna as claimed in claim 10, wherein the feed line is connected to at least one dipole structure by a probe.

13. A dual polarization antenna including a non-conducting space surrounded by a ground plane, two angularly offset sets of dipole structures overlying the space, each set having an orientation and comprising a pair of aligned short-circuit elongate dipoles extending from the ground plane over the space from diametrically opposed directions to terminate in free ends adjacent but spaced from each other to define a gap between said free ends, and separate means for exciting each set, or dipole structure within a set, individually.

14. An antenna as claimed in claim 13, further comprising a radiating element overlying the dipole structures such that the dipole structures couple, in use, with the radiating element causing it to radiate polarizations determined by the orientation of each of said sets of dipole structures.

15. An antenna as claimed in claim 14, wherein the space, radiating element and dipole structure are symmetrical about intended planes of polarization.

16. A dual polarization antenna including a non-conducting space surrounded by a ground plane, two angularly offset sets of dipole structures penetrating into the space, each set comprising a pair of aligned dipole structures extending into the space from diametrically opposed directions and terminating in free ends, each dipole structure of said sets of dipole structures comprising a conducting element extending from the ground plane to a respective free end, and a pair of parallel open-circuit dipoles extending from the free end back along respective sides of the conducting element, the free ends being adjacent but spaced from each other to define a gap between said free ends, and separate means for exciting each set, or dipole structure within a set, individually.

17. A dual polarization antenna as claimed in claim 16, wherein the conducting elements are connected to the ground plane at a voltage node.

* * * * *

UNITED STATES PATENT AND TRADEMARK OFFICE

CERTIFICATE OF CORRECTION

PATENT NO. : 5,691,734

DATED : November 25, 1997

INVENTOR(S) : Richard Simon Greville DAVIES

It is certified that error appears in the above-indentified patent and that said Letters Patent is hereby corrected as shown below:

In the title of the invention, Item [54], change "polarizating" to --polarization--.

Signed and Sealed this

Twenty-seventh Day of January, 1998

*Attest:*

Bruce Lehman

BRUCE LEHMAN

*Attesting Officer*

*Commissioner of Patents and Trademarks*